United States Patent [19]

Prusak

[11] 4,400,245

[45] Aug. 23, 1983

[54] MATRIXING PROCESS FOR THE MANUFACTURE OF MOLDED RECORDS

[75] Inventor: John J. Prusak, Indianapolis, Ind.

[73] Assignee: RCA Corporation, New York, N.Y.

[21] Appl. No.: 325,995

[22] Filed: Nov. 30, 1981

[51] Int. Cl.[3] ..... C25D 1/10; C25D 17/12

[52] U.S. Cl. ..... 204/5; 204/281

[58] Field of Search ..... 204/5, 281

[56] References Cited

U.S. PATENT DOCUMENTS 2,018,471 10/1935 Russell ..... 204/281

*Primary Examiner*—T. M. Tufariello

*Attorney, Agent, or Firm*—Birgit E. Morris; Edward J. Sites

[57] ABSTRACT

A process improvement is disclosed for use in the matrixing process employed in the manufacture of molded records. In accordance with the disclosure, a narrow texturized band is provided in either the outer or inner unrecorded areas of a matrix or in both areas of a matrix, so that when a replica is electroformed on the matrix the texturized bands will provide sufficient additional grip of the replica to the matrix to prevent premature separation.

6 Claims, 3 Drawing Figures

MATRIXING PROCESS FOR THE MANUFACTURE OF MOLDED RECORDS

This invention relates to an improved process for use in the matrixing procedure employed in the manufacture of molded records and more particularly is concerned with an improvement which substantially reduces or eliminates the problem of premature separation of electroformed replicas from the matrixes on which they are formed.

BACKGROUND OF THE INVENTION

In the manufacture of molded records such as conventional audio records or the more recently developed videodisc, a plastic material is molded between a pair of metal discs referred to as stampers. The stampers have defined in their molding surfaces an information track which contains the surface relief pattern representative of information desired to be molded into the molded records. The stampers are the end product of a replication process known generally as matrixing.

The first step in the record making process is to record the program information desired to be molded into the final record on a magnetic tape. The magnetic tape is then used to control a tool which cuts an information track containing the desired programing into a flat disc called a recording substrate. The recording substrate is usually a metal plate which has a layer of material on its surface into which the information track is cut; in the case of audio records, the material is generally made of wax or a synthetic lacquer; in the case of video discs, the material is generally a layer of an electrodeposited metal such as a bright copper.

The recording substrate, having the information defined in its surface, is thereafter replicated in a series of electroforming steps. In the first step, a metal, such as nickel, is electrodeposited on the recorded surface of the recording substrate until a self-sustaining part is obtained. The resulting electroformed part, called a master, is then carefully separared from the recording substrate. The master is then in turn replicated by electroforming a metal such as nickel, on the recorded surface of the master. After a sufficient thickness of metal has been deposited on the master to form a self-sustaining part, the resulting replica, referred to as a mold, is separated from the master. The molds which are obtained are then in turn likewise replicated to produce a series of parts known as stampers. The stampers that are obtained are negative replicas of the starting recording substrate and are used to mold the records, as noted above.

In the matrixing process parts such as the masters and molds are initially formed as replicas and then are themselves used as matrixes that is a part on which a replica is formed. Since the present invention is generally useful in the matrixing process without specific regard to whether the part is actually a recording substrate, master, mold, or stamper, the term matrix will be used hereinafter to refer to a part which is replicated and the term replica will be used hereinafter to refer to a part which is electroformed on the matrix.

One of the major problems encountered in the matrixing process is premature separation of the replicas from the matrixes on which they are electroformed, which can occur at various stages in the matrixing process. For example, premature separation can occur during the electroforming of the metal onto the matrix. This results in the production of defective parts in that the replica will have insufficient thickness, and furthermore, it causes leakage of electrolyte between the replica and the matrix which can result in burnouts of the matrixes and other related problems. Also when the replica has been completely electroformed on the matrix and is being removed from the electroforming apparatus or being transferred to other operations, if a replica prematurely separates at this point, it is often damaged by being dropped or the like. Also, as a result of premature separation, there is often sliding contact between the matrix and the replica which results in either or both the replica and the matrix being scratched and irreparably damaged.

The problem of premature separation is an extremely difficult problem to overcome in that certain required matrixing procedures and the required surface characteristics of the replicas and matrix are in part a cause of the problem. For example, in the matrixing process the matrixes must be passivated so as to prevent the adhesion and possible alloying of the metal which is electrodeposited to form the replica with the metal of the matrix. For this reason, it is highly desirable for most purposes in the electroforming operation, especially when it is desired to separate the replicas from the matrix, to have as passive layer as possible deposited on the matrix. The matrixes and the resulting replicas are also deliberately designed so that they have not undercutting or the like which mechanically interlock the parts since such undercuts would adversely affect the release properties when molding plastic materials. In addition, the outer edges of the matrixes and the center portions of the matrixes are designed to be smooth, almost mirror-like, so as to promote release of the molding materials from the stampers. Even in the recorded areas of the replicas, especially on a video disc, the area is effectively smooth because of the relative closeness and the shallowness of the information track in the program area.

Various attempts have been made to reduce or eliminate premature separation of replicas and matrixes. One such suggestion was to preplate matrixes with the outer edge of matrixes exposed so as to induce plating over and around the outer edge of the matrixes. The plating over the outer edge of the matrix was intended to form a grip to hold the replica in place on the matrix during completion of the matrixing process. This technique has, however, not proved to be satisfactory as it has had limited success in reducing premature separation, has added a separated time-consuming step to the matrixing process and has caused problems in separation of the replicas from the matrix because the extra metal on the edge plating has to be removed either by being cut off or ground off the matrix.

It was also suggested in the prior art to knurl the unrecorded outer edge of the matrixes and possibly also the center of the matrixes so as to improve the grip of the replicas to the matrix. Knurling, however, has not proven to be a satisfactory solution. It was found that the knurling had to be forced into the replicas for a substantial depth in order to be effective in holding a replica onto the matrix. The amount and depth of knurling required resulted in considerable amount of metal being displaced in the knurling process which in turn caused distortion of the information track in the recorded area of the replicas. A further problem encountered with knurling was that the knurling if sufficiently deep enough resulted in deep lines or raised ridges in the outer edge of the molded recorded which was highly undesirable with regard to use of that portion for the lead-in track on the records.

What would be highly advantageous would be a process to reduce or eliminate premature separation of replicas from their matrixes which is simple to perform, and which would not result in any adverse effects on the final molded records.

BRIEF SUMMARY OF THE INVENTION

A process improvement is provided in the matrixing process which reduces or eliminates the problems of premature separation of replicas from the matrixes on which they are formed. A thin texturized band is provided in either the outer or inner unrecorded portions of the matrix or both areas of the matrix. When a replica is electroformed on the matrix, the bands provided a sufficient grip of the replica to the matrix to prevent premature separation.

DETAILED DESCRIPTION OF THE INVENTION

Figure 1:
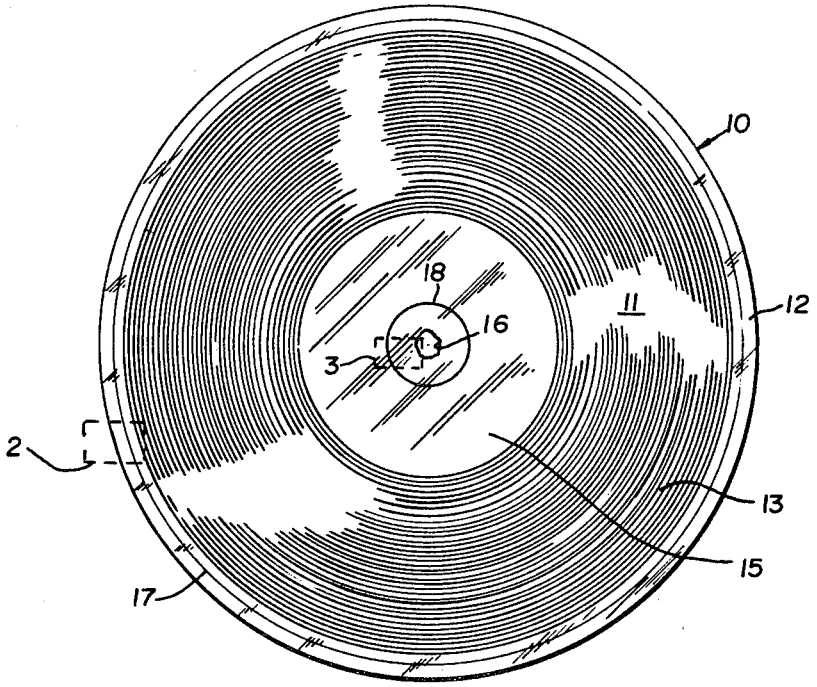
FIG. 1 is a top plan view of a typical matrix having an inner and outer texturized band.
Figure 2:
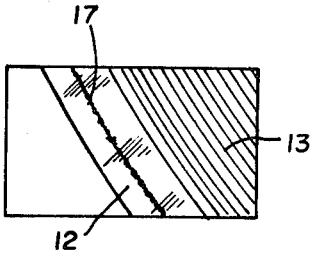
FIG. 2 is an enlarged illustration taken as indicated by the lines and arrow 2 on FIG. 1.
Figure 3:
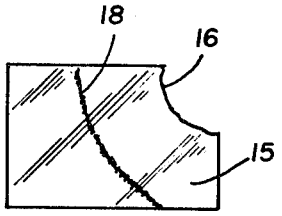
FIG. 3 is an enlarged illustration taken as indicated by the lines and arrows 3 of FIG. 1.

The matrixes 10 employed in the manufacture of molded records are made of electrodeposited metals such as nickel. Considerable care is taken in the electroforming process to ensure that the metals deposited are in as bright and smooth a form as possible. The reason for depositing the metal in a bright, smooth layer is that any surface rouchness in the program area that is the recorded area, whould inherently add undesirable noise to the information track.

The matrix 10 as formed will have at least three distinct zones on the recorded surface 11, namely, an outer zone 12 around the outer diameter of the matrix which does not contain an information track, an intermediate zone 13 which does contain an information track and an inner zone 15 which surrounds the center hole 16 of the matrix, which is also unrecorded. The outer zone 12 and the inner zone 15 are normally formed so as to have an extremely smooth, almost mirror-like finish.

In accordance with this invention as illustrated, an outer texturized band 17 is provided in the outer zone 12 and an inner texturized band 18 is provided in the inner zone 15. The texturized bands 17 and 18 are formed by disrupting the mirrorlike smoothness of the shiny metal in the inner zone 15 and the outer zone 12 of the matrix 10. The preferred method to form the texturized bands 17 and 18 is to either etch the ring with an electric resistance etcher or to deposit additional material on the surface of the metal matrix, as for example, with a tungsten carbide electric etcher. Other methods can likewise be used, such as chemically etching the surface of the matrix through a photoresist mask, or the like. The amount of texturizing required for the purposes of this invention need only be that amount sufficient to break the surface smoothness of the metal surface. The amounts of etching required is such that the etching can readily be observed with the unassisted eye.

The texturized bands 17, 18 should be preferrably applied as continuous circular rings about the outer zone 12 and the center hole 16 in the inner zone 15.

The width of the texturized bands 17, 18 surprizingly does not have to be very wide in order to be effective in preventing premature separation. For example, a texturized band 17 about the outer zone 12 which is about $\frac{1}{8}$ of an inch wide (3.175 mm) has been found to give excellent results in preventing premature separation of the replicas from the matrixes. It is believed that the use of a circular band about the entire diameter is effective in preventing premature separation because localized forces which would normally cause separation are distributed over the entire diameter of the matrix. The bands 17 and 18 can of course be somewhat wider than desired but the additional width does not seem to be required and increases the amount of time required for etching or depositing the bands 17, 18 on the matrix 10.

The exact position of the texturized bands 17, 18 in the unrecorded inner zone 15 and the outer zone 12 does not appear to be critical. The texturized band has a sufficient smoothness relative to the unetched portion of the unrecorded zones so that it does not interfere with the travel of the stylus across the surface of the records molded on the stampers. However, in order to prevent any possible problems with regard to release of the records molded on the stampers having the texturized bands, it is somewhat advantageous to place the band at a position beyond the molding land of the record, that is, on the outer portion of the stamper which will be shaped to fit over the platen of the molding press. In the same way, the inner texturized band 18 in certain types of records such as video discs which have a large center hole, can be positioned so that it is removed in the final forming operations of the stampers.

The texturized bands 17, 18 are preferrably imparted to the first metal part in the matrixing process since the texturized bands will thereafter be duplicated in the matrixing process in each of the replicas formed on a given matrix. When using a metal recording substrate such as that generally employed in the manufacture of video disc, the bands 17, 18 are advantageously formed on the recording substrate and thereafter reproduced in the master, molds, and stampers. When using a wax or lacquer substrate, the bands 17 and 18 are preferrably formed onto the master and thereafter reproduced in the molds and stampers. The texturized bands 17, 18 are formed on the unpassivated metal matrixes and then the matrix is passivated prior to being used in the electroforming process in order to prevent the alloying of the deposited metal with the metal of the matrix in the area wherein the texturized bands are placed on the metal matrix.

The bands 17, 18 as noted above are effective in preventing premature separation. The texturized bands 17, 18 have also proved to be highly effective when it is desired to separate the replicas from the matrix. The slight but effective gripping action imparted by the texturized bands 17, 18 permits a simple but highly controlled separation of the replicas from the matrix, rather than a snapping uncontrolled release often encountered with unmodified matrixes and replicas.

While the preferred embodiment of the present invention as described above gives the optimum results, it should be appreciated that certain variations can be made in the process which will likewise result in reducing premature separation of the replicas from the matrixes and that these variations are included within the scope of the present invention. For example, while it is preferable to use both an inner and outer texturized band, much of the advantages of this invention can likewise be obtained when only one band, preferrably the outer band, is utilized on the matrixes. Furthermore, while it is preferred to use a continuous texturized band 17, 18 in order to obtain the results desired in the present invention, it is also possible to use a discontinuous band consisting of texturized portions and nontexturized portions and still obtain many of the benefits of the present invention. Another variation of the present invention which can be employed is to use a wider texturized band at either the inner or outer unrecorded zones of the matrix or use a multiple number of bands at either the inner or outer zones of the matrix. These and other such similar variations are included within the scope of the present invention.

I claim:

1. In the matrixing process employed in the manufacture of molded records in which a flat matrix having a surface comprised of a flat unrecorded bright metal circumferential outer-most zone, an adjacent intermediate recorded zone containing an information track, and an inner unrecorded bright metal zone is electroformed with a metal on said surface to form a replica thereon: the improvement which comprises: texturizing a circumferential portion of at least one of the unrecorded bright metal zones to provide a circular texturized band of sufficient roughness to prevent premature separation of the replica from the surface of the matrix.

2. The improvement according to claim 1 wherein the texturized band is of sufficient roughness to be observed on the bright metal zone with the unassisted eye.

3. The improvement according to claim 1 wherein the texturized band is applied in the flat outer-most zone.

4. The improvement according to claim 1 wherein texturized bands are applied in both the inner and outer-most zones.

5. The improvement according to claim 1 wherein the texturized band is about $\frac{1}{8}$ of an inch (3.175 mm) in width.

6. The improvement according to claim 1 wherein the texturized band is applied in an area outside of the molding area of a stamper to be derived from the replica.

* * * * *